US006572457B2

(12) United States Patent
DePalma et al.

(10) Patent No.: US 6,572,457 B2
(45) Date of Patent: Jun. 3, 2003

(54) SYSTEM AND METHOD FOR CONTROLLING HUMIDITY IN A CRYOGENIC AEROSOL SPRAY CLEANING SYSTEM

(75) Inventors: Philip W. DePalma, Goshen, NY (US); Robert Sherman, New Providence, NJ (US)

(73) Assignee: Applied Surface Technologies, New Providence, NJ (US)

( * ) Notice: Subject to any disclaimer, the term of this patent is extended or adjusted under 35 U.S.C. 154(b) by 24 days.

(21) Appl. No.: 09/919,545

(22) Filed: Jul. 31, 2001

(65) Prior Publication Data

US 2002/0022435 A1 Feb. 21, 2002

Related U.S. Application Data

(62) Division of application No. 09/150,441, filed on Sep. 9, 1998, now abandoned.

(51) Int. Cl.[7] ..... B24C 9/00

(52) U.S. Cl. ..... 451/89; 451/53; 451/39; 451/40

(58) Field of Search ..... 451/38, 39, 40, 451/53, 87, 88, 89; 134/2, 6, 7, 8, 18, 21, 31, 32, 17, 93–103.1; 55/385.2; 34/446, 448, 491

(56) References Cited

U.S. PATENT DOCUMENTS

| | | | | |
|---|---|---|---|---|
| 3,676,963 A | | 7/1972 | Rice et al. | |
| 4,038,786 A | | 8/1977 | Fong | |
| 4,631,250 A | | 12/1986 | Hayashi | |
| 4,832,753 A | | 5/1989 | Cherry et al. | |
| 4,932,168 A | | 6/1990 | Tada et al. | |
| 4,936,922 A | | 6/1990 | Cherry | |
| 5,039,321 A | | 8/1991 | Satoh et al. | |
| 5,062,898 A | | 11/1991 | McDermott et al. | |
| 5,113,882 A | * | 5/1992 | Gileta | 134/19 |
| 5,123,207 A | | 6/1992 | Gillis, Jr. et al. | |
| 5,193,560 A | * | 3/1993 | Tanaka et al. | 134/56 R |
| 5,209,028 A | | 5/1993 | MDermott et al. | |
| 5,294,261 A | | 3/1994 | McDermott et al. | |
| 5,315,793 A | | 5/1994 | Peterson et al. | |
| 5,316,560 A | | 5/1994 | Krone-Schmidt et al. | |
| 5,366,156 A | | 11/1994 | Bauer et al. | |
| 5,483,563 A | | 1/1996 | Herb | |
| 5,486,132 A | | 1/1996 | Cavaliere et al. | |
| 5,651,723 A | | 7/1997 | Bjornard et al. | |
| 5,700,190 A | | 12/1997 | Johnson et al. | |
| 5,725,664 A | | 3/1998 | Nanbu et al. | |
| 5,890,367 A | | 4/1999 | You et al. | |
| 6,165,053 A | * | 12/2000 | Yokokawa et al. | 451/53 |
| 6,357,457 B1 | * | 3/2002 | Taniyama et al. | 134/57 R |

OTHER PUBLICATIONS

Hoenig, The Application of Dry Ice To The Removal Of Particulates From Optical Apparatus, Spacecraft, Semiconductor Wafers, And Equipment Used in Containment Free Manufacturing Processes, Sep. 1985.

* cited by examiner

*Primary Examiner*—Eileen P. Morgan
(74) *Attorney, Agent, or Firm*—David Fortunato; Riker, Danzig

(57) ABSTRACT

Humidity within the workspace of a cryogenic aerosol spray cleaning system is controlled by circulating the workspace atmosphere through a dehumidifier. Advantageously, the need for purging of the workspace atmosphere prior to each cleaning cycle is eliminated. A system and method are thereby provided for cleaning of large workspaces. The system amd method of the invention are especially well-suited, economical, and practical for cleaning operations in which a dry air or inert gas purge of a large volume cleaning chamber would be impractical.

10 Claims, 5 Drawing Sheets

SYSTEM AND METHOD FOR CONTROLLING HUMIDITY IN A CRYOGENIC AEROSOL SPRAY CLEANING SYSTEM

CROSS REFERENCE TO RELATED APPLICATION

This application is a division of U.S. patent application Ser. No. 09/150,441, filed on Sep. 9, 1998, and now abandoned.

BACKGROUND OF THE INVENTION

1. Field of the Invention

This invention relates to cryogenic cleaning systems, and more particularly, to a system and method for controlling the humidity within the workspace of a cryogenic aerosol spray cleaning system by circulating the workspace atmosphere through a dehumidifier to eliminate the need to purge the workspace prior to each cleaning cycle.

2. Description of the Prior Art

Precision cleaning using solid, liquid, or gaseous carbon dioxide, or other cryogenic based cleaning materials and methods, including mixed carbon dioxide 20 phases, solid or liquid argon sprays, liquid nitrogen sprays, and even ice ($H_2O$), or combinations of these materials and methods, has been disclosed by patents and prior art publications. The cryogenic spray cleaning technologies disclosed by the prior art have evolved in response to many commercial, industrial, and practical concerns, including environmental concerns, and the need for better and more effective cleaning methods for both particle and organic-based contamination.

Carbon dioxide snow cleaning was first disclosed by S. A. Hoenig around 1985. The process typically involves cleaning, using a source of fluid (i.e., liquid or gaseous) carbon dioxide provided at a certain enthalpy condition (i.e., temperature and pressure). Such liquid carbon dioxide (or gaseous carbon dioxide if proper adiabatic conditions are met by the nozzle design) is passed at high velocity through an orifice of a spray nozzle. Upon exiting the orifice, a stream of dry ice particles having varying sizes and densities and traveling at varying velocities is directed at a workpiece for removal of contaminates deposited on a surface thereof. The stream of dry ice particles may be combined with $CO_2$ gas, nitrogen or other dry gases to boost 10 the dry ice velocity.

Another form of cryogenic cleaning uses macroscopic $CO_2$ pellets and was first described by Rice et al. in U.S. Pat. No. 3,676,963, and by Fong in U.S. Pat. No. 4,038,786. This snow cleaning method feeds dry ice pellets into a dry carrier gas stream such as nitrogen or dry compressed air, at a pressure typically in the range of between 40 and 300 psi and possibly greater. The dry ice pellets are accelerated toward the surface of a workpiece at such high velocity that even thick coatings such as paint can be removed.

One limitation in cryogenic spray cleaning methods is the fact that extremely cold streams (e. g., typically −60° C. for carbon dioxide snow cleaning) of cleaning medium are applied to the surface of the workpiece being cleaned. Consequently, when the cleaning processes are conducted at room temperature, or in any unsealed and uncontrolled environment, condensation can form on the workpiece surface being cleaned, or on the spray nozzle. The moisture condensation, present as water, frost, or ice, interferes with and impedes the cleaning process. Prior art attempts to eliminate moisture include direct heating, heating with blanketing gases or heating only specific portions of the surface of the workpiece, insulating the cleaning chamber, cleaning in vacuum environments, purging with nitrogen, air or other dry inert gases, purging using specially constructed chambers, and other methods utilized to produce dry environments.

Patents directed to clean and dry chambers for cryogenic spray cleaning systems and methods typically include vacuum chambers and/or require purging a clean dry box with a dry inert gas. For example, U.S. Pat. No. 4,631,250 to Hayashi was the first to mention indirectly the need for a sealed chamber for a cleaning system that had mixed CO2 and nitrogen for cleaning a wafer surface. The sealed chamber included a vacuum exhaust line for removal of contaminants. Of course, a vacuum environment also assists in moisture reduction.

Another attempt to control the humidity in the cleaning chamber of a cryogenic cleaning system is disclosed in U.S. Pat. No. 5,316,560 to Krone-Schmidt et al. This patent discloses purging an enclosed space (i.e., a cleaning chamber) with dry nitrogen gas to control the humidity within the chamber. Essential to this system is the chamber within a chamber design having a purged airlock between the enclosed interior cleaning chamber and the exterior of the system. The system disclosed by this reference requires lengthy purge times to dry out the cleaning chamber before initiation of a cleaning cycle, and may therefore not be practical for cleaning a large workpiece in a large volume cleaning chamber.

In U.S. Pat. No. 5,315,793 to Peterson et al., an apparatus for precision cleaning using $CO_2$ snow or other cryogenic sprays is disclosed. The apparatus disclosed is intended only as a final cleaning station and has some design features in common with U.S. Pat. No. 5,316,560. The dryness of the sealed chamber is maintained by vacuum or by an external inert gas purge. The preferred method for maintaining a dry environment involves pumping out and then back-filling the chamber with a dry gas after each cleaning cycle, i.e., to purge the cleaning chamber.

Cryogenic argon spray cleaning developed as an alternative to $CO_2$ snow cleaning. Cryogenic argon spray cleaning, and, in parallel, cryogenic nitrogen spray cleaning, were first mentioned in U.S. Pat. No. 5,062,898, and later in U.S. Pat. No. 5,294,261, and still further developed in U.S. Pat. No. 5,209,028, all to McDermott et al. These patents disclose the nozzles and cleaning stations for cryogenic argon spray cleaning, and methods and procedures for ensuring a dry cleaning station based upon a flush gas for removal of contaminants.

Further developments in cryogenic argon spray cleaning are disclosed in U.S. Pat. No. 5,486,132 to Cavalier et al. and in U.S. Pat. No. 5,366,156 to Bauer et al., wherein argon spray cleaning methods and apparatus are extended to include cryogenic nitrogen or mixed argon and nitrogen. These patents also clearly discuss means to reduce and prevent moisture condensation from forming on the apparatus, nozzles, argon or nitrogen lines, and on the workpiece surface to be cleaned.

Moisture elimination methods discussed and claimed included purge means, such as dry gas purge methods with purge ports and purge gas sources, providing a vacuum about the cryogenic argon lines and nozzle, providing thermal insulation and barriers and positive pressure within the enclosures, and other suggestions unrelated to the present invention.

A means for eliminating moisture in a CO? dry ice pellet system cleaning apparatus is disclosed in U.S. Pat. No.

5,651,723 to Bjornard et al. The apparatus disclosed therein includes separate load locks for loading and unloading a workpiece, a cleaning chamber between the two load locks, and the necessary equipment to provide airflow through the cleaning chamber and apparatus and to purge the cleaning chamber. Dry compressed air is required for accelerating the dry ice pellets only. A dry environment was ensured in the load locks by purge methods and all chambers were kept at positive pressures to keep moisture out.

Systems and apparatus for maintaining a dry and clean manufacturing environment abound within the electronic, chemical and pharmaceutical industries. However, none of the known systems, apparatus, methods, processes, etc. use a dehumidifier in conjunction with a cryogenic spray cleaning process to control the humidity within a cleaning chamber, thereby obviating the need for time-consuming and expensive purging of the cleaning chamber. For large cleaning chambers, purging as a means for controlling humidity within a cleaning chamber becomes cost-prohibitive, and therefore, commercially impractical.

The present invention overcomes the shortcomings of the prior art by providing a system and method for controlling the humidity within the workspace of a cryogenic aerosol spray cleaning system by circulating the workspace atmosphere through a dehumidifier placed in the airflow path of the cleaning system. The present invention obviates the need to purge the workspace atmosphere at any time during a cleaning cycle and further eliminates the need to provide a sealed cleaning chamber. The present invention provides for rapid moisture removal from the workspace atmosphere and for dehumidifying the entire atmosphere in a relatively short period, typically approximately two minutes. This, in turn, leads to increased productivity for the cryogenic cleaning system.

SUMMARY OF THE INVENTION

The present invention provides a system and method for controlling the humidity within the workspace of a cryogenic aerosol spray cleaning system by circulating the workspace atmosphere through a dehumidifier to eliminate the need to purge the workspace prior to each cleaning cycle. The system and method of the present invention are especially well-suited, economical, and a practical necessity for cleaning of large workpieces, where a dry air or inert gas purge of a large volume cleaning chamber, as required by prior art methods and apparatus, would be impractical.

Prior art systems and methods for controlling the humidity in a cryogenic cleaning system require time-consuming inert gas purges, expensive vacuums or other means, most all in conjunction with load locks. On the other hand, the present invention eliminates the need to purge the cleaning chamber workspace and produces a dry, cleaning environment quickly and economically. The present invention also eliminates the need to provide a sealed cleaning chamber and to provide load locks at the input and output sides of the cleaning chamber; all directed to maintaining a clean and dry environment within the cleaning chamber. The workspace atmosphere is cycled through the dehumidifier many times a minute to insure a fast dry out time.

An integral aspect of the humidity control system of the present invention is the handling of the gaseous and particulate constituents, i.e., moisture and particulate matter, present in the atmosphere within the cleaning chamber workspace. More specifically, cryogenic snow cleaning requires a virtually moisture-free and particle-free workspace atmosphere within the cleaning chamber. The present invention satisfies this requirement in a manner not disclosed or suggested by the prior art.

The humidity control system of the present invention incorporates a dehumidifier into at an airflow path defined through a cryogenic aerosol spray cleaning system including a cleaning chamber having a workspace defined therein.

The workspace atmosphere is continuously or intermittently circulated through the dehumidifier to remove moisture before, during, and/or after a cleaning cycle. An optional HEPA filter may be provided in the airflow path to remove particulate contaminants from the workspace atmosphere. A secondary airflow path may be defined through the cleaning system through which a portion of the workspace atmosphere is continuously or intermittently circulated. The dehumidifier and optional HEPA filter are located in the secondary airflow path to remove moisture and particulate contaminants from the workspace atmosphere.

The present invention is directed to a method for controlling the humidity within a cleaning chamber of a cryogenic cleaning system. The cleaning chamber has a workspace defined therein within which a workpiece may be removably placed for cryogenic cleaning during a cleaning cycle. The workspace has a partly gaseous (defined hereinafter) atmosphere therein and the cleaning system has an airflow path defined therethrough. The method of the present invention comprises the step of circulating the workspace atmosphere through a dehumidifier of an air handling system located in the airflow path for removing moisture from the gaseous part of the workspace atmosphere to reduce the humidity in the workspace atmosphere without having to purge the workspace prior to the initiation of a cleaning cycle.

The present invention is also directed to a humidity control system for a cleaning chamber of a cryogenic cleaning system. The cleaning chamber has a workspace defined therein within which a workpiece may be removably placed for cleaning during a cryogenic cleaning cycle. The workspace has a partly gaseous atmosphere therein and the cleaning system has an airflow path defined therethrough.

The cryogenic cleaning system further includes a spray nozzle located within the cleaning chamber and connected to a cleaning media source for producing a stream of solid or liquid cryogenic spray entrained by a gas phase for cryogenically cleaning the workpiece during a cleaning cycle. The humidity control system comprises a dehumidifier of an air handling system located in the airflow path and through which the workspace atmosphere is circulated for removing moisture from the gaseous part of the workspace atmosphere to reduce the humidity in said workspace without having to purge the cleaning chamber prior to initiation of a cleaning cycle.

The humidity control system of the present invention may be used in an automated or manual cryogenic cleaning system. For automated systems, motion control equipment may be included in the workspace to manipulate the workpiece (e.g., movement into and out of the workspace and manipulation therein) and cleaning components (e.g., spray nozzles). For manual cleaning systems, a glove port may be provided on a front side of the cleaning chamber through which access to the workpiece and cleaning components is provided.

BRIEF DESCRIPTION OF THE DRAWINGS

The invention will be more fully understood and further advantages will become apparent when reference is made to the following detailed description of the preferred embodiments of the invention and the accompanying drawings in which like reference characters denote similar elements throughout the several views and wherein.

DESCRIPTION OF THE PREFERRED EMBODIMENTS

The present invention provides a system and method for controlling the humidity within the workspace of a cryogenic aerosol spray cleaning system. By continuously or intermittently circulating at least a portion of the workspace atmosphere through a dehumidifier, the present invention eliminates the costly and time-consuming practice of purging the workspace before each cleaning cycle to ensure a dry environment within the workspace. Also eliminated by the present invention is the need for load locks at the ingress and egress points of the cleaning chamber and the need to provide an airtight or sealed cleaning chamber. Workpieces of all sizes may now be cleaned virtually without regard for the time-constraints that heretofore have accompanied purging of large volume cleaning chambers. Quite simply, the system and method of the present invention significantly improve the performance, robustness, and operation of cryogenic aerosol spray cleaning systems.

Figure 1:
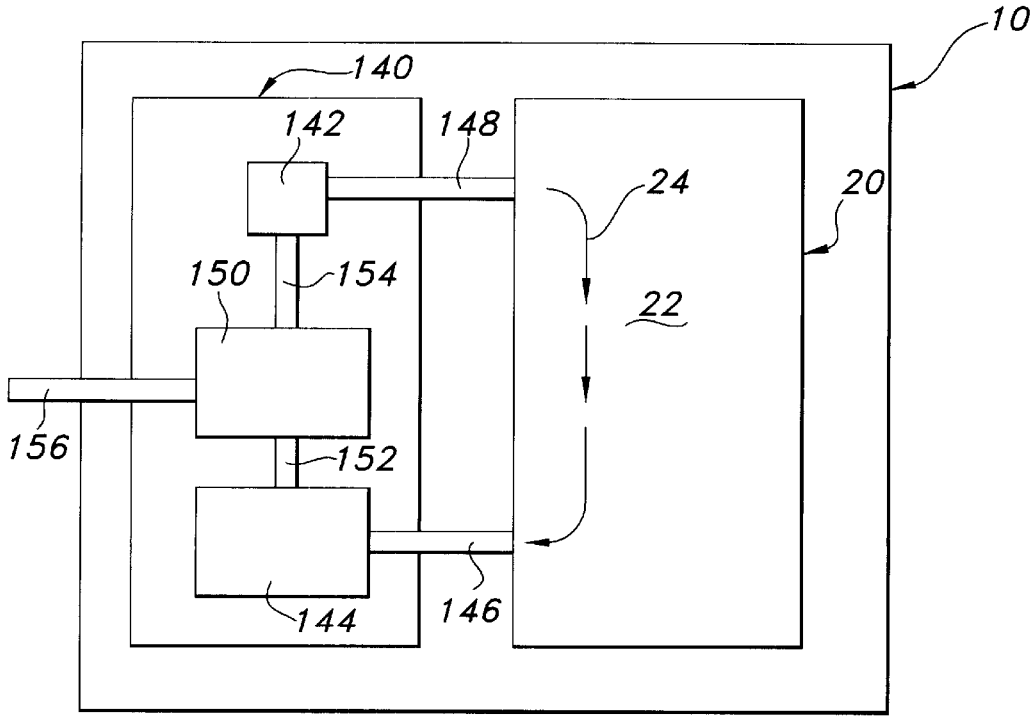
FIG. 1 is a schematic block diagram of a humidity control system having a dehumidifier connected in series with a primary airflow path and constructed in accordance with the present invention.
Figure 3:
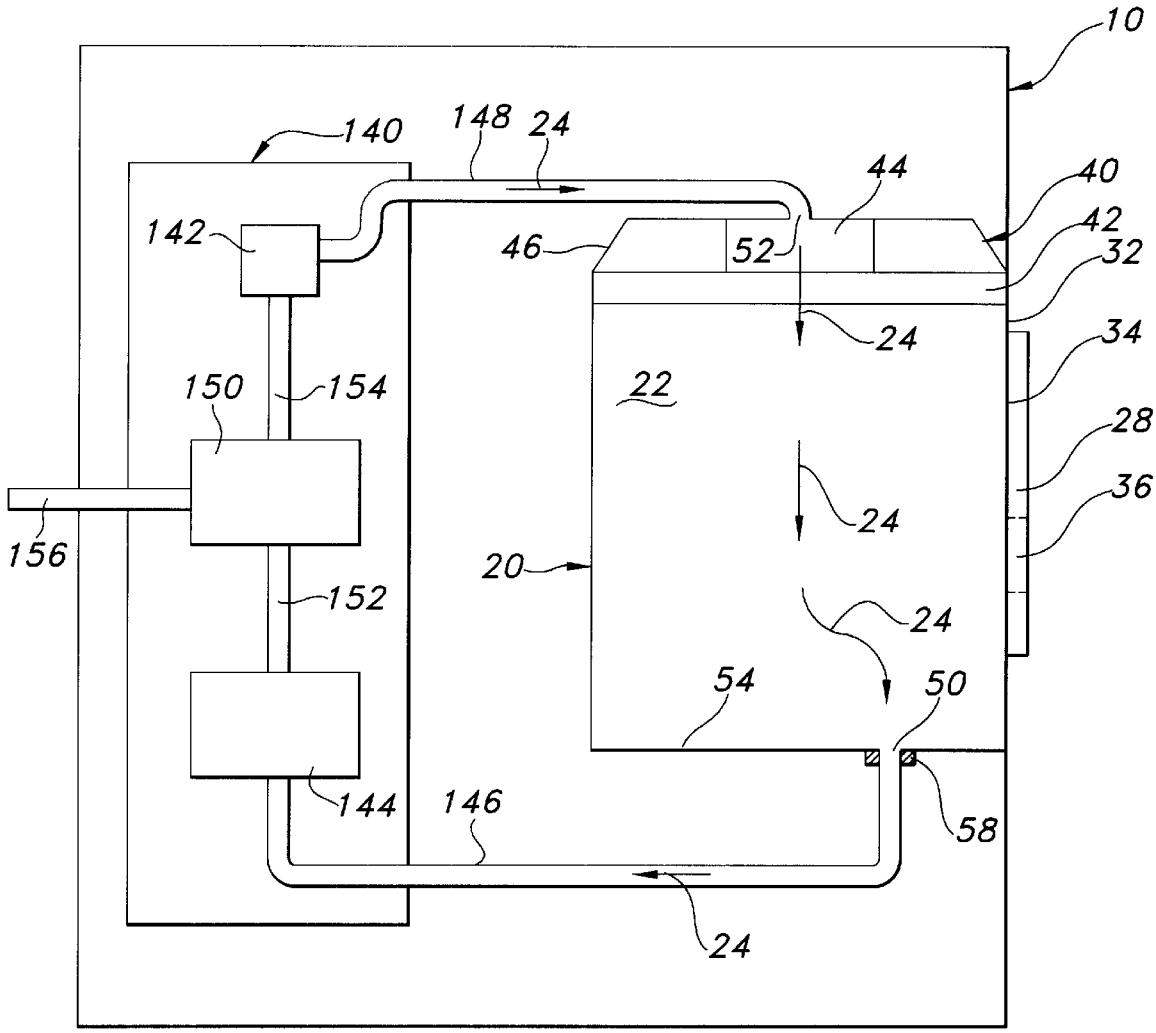
FIG. 3 is a detailed view of the humidity control system of FIG. 1.

Referring to the drawings, in FIGS. 1 and 3 there is shown a first embodiment of a humidity control system 10 for use in a cryogenic aerosol spray cleaning system 100 (see FIG. 6) and constructed in accordance with the present invention. The humidity control system 10 includes a cleaning chamber 20 that defines a workspace within which a workpiece 70 (not shown in FIG. 1) may be cleaned using virtually any precision cleaning process and preferably, a cryogenic aerosol spray cleaning process (i.e., snow cleaning). While carbon dioxide snow is the preferred cleaning medium, argon, nitrogen, dry ice pellets, and combinations thereof may also be used in connection with the present invention. The workpiece 70 is placed into and removed from the cleaning chamber 20 by automatic or manual means, preferably through a chamber door 28, which may or may not make an airtight seal with the chamber, r front surface 32. The atmosphere within the workspace 22 comprises air, or some other inert gas or combination of gases and various particulate matter. The atmosphere is continuously or intermittently circulated through the humidity control system 10 (i.e., through the cleaning chamber 20 and through the workspace 22) over a primary airflow path 24.

As used herein, the terms "atmosphere" and "partly gaseous atmosphere" refer to the gaseous and particulate contents of the workspace 22. It will be obvious to persons skilled in the art that the workspace atmosphere may consist of various inert gases, either singularly, or in combination, and that the term "atmosphere" is used for ease of discussion and is in no way a limitation of the present invention. The term "air" is used generally herein to refer to the workspace atmosphere as it travels over the primary and secondary airflow paths 24, 26, as it moves through the air handling system 140, and as it otherwise travels through the various tubes, pipes, conduits, openings, and other liquid transport means of a humidity control system 10 and of a cryogenic cleaning system 100.

The cleaning chamber 20 includes a particulate filter assembly 40 having a particulate filter 42, preferably a HEPA filter, and a blower 44 that facilitates circulation of air over the primary airflow path 24 and of the workspace atmosphere within and through the workspace 22. Ductwork 46 spreads the dry air uniformly as it enters the workspace 22. The output of the filter assembly 40 is clean, dry, and particle free, providing an ideal atmosphere for cryogenic cleaning.

A seal, which may or may not be airtight is created between the door 28 and a front surface 32 of the cleaning chamber 20 by a gasket 34, O-ring or other generally pliant or sealing material to minimize leakage about the door 28. The door 28 may include a glove port 36 having two gloves (not shown)that facilitate insulated communication with the workspace 22 and permit manual manipulation of a workpiece 70 or other cleaning equipment located within the workspace 22. The glove port 36 is typically provided for manually operated cryogenic cleaning systems 100. When a humidity control system 10 in accordance with the present invention is configured for automatic operation (as described in detail below), a glove port 36 is not provided in the door.

The bottom 54 of the cleaning chamber 20 includes at least one chamber output port 50 through which the workspace atmosphere exits the cleaning chamber 20. An optional prefilter 58 may be provided at the output port 50 for removing particulate matter from the workspace atmosphere before it enters the air handling system 140. Of course, more than one output port 50 may be provided, with prefilters 58 as required.

The air handling system 140 comprises a section of the primary airflow path 24 and includes a blower 144 or other gas moving device, a particulate filter 142, preferably a HEPA filter, and a dehumidifier 150. In FIGS. 1 and 3, the blower 144 is located at the air handling system input 146, the HEPA filter is located at the air handling system output 148, with the dehumidifier 150 fluidly connected therebetween. It will be obvious to persons skilled in the art that the components of the air handling system 140 may be arranged and connected in a variety of ways, in accordance with the scope and spirit of the present invention; as long as at least a portion of the workspace atmosphere is directed through the dehumidifier 150. When connected as shown in FIGS. 1 and 3, moist air exits the cleaning chamber 20 and enters the air handling system 140 via an input port 146. The blower 144 facilitates continuous movement of the air through the air handling system 140 and directs the moist air to the dehumidifier input port 152. Moisture is removed from the air and ported out of the humidity control system 10 via a dehumidifier exhaust port 156. Dry air exits the dehumidifier via a dry air output port 154 and is directed into the HEPA filter 142, where particulate matter is trapped and removed from the dry air. Clean dry air is now returned to the cleaning chamber 20 (i.e., to the workspace 22) via an air handling system output port 148. In FIG. 1, a primary airflow path 24 is defined through the humidity control system 10 which flows, in its entirety, through the air handling system 140 and dehumidifier 150. Thus, the dehumidifier 150 is placed in series with the primary airflow path 24 of the humidity control system 10.

The dehumidifier 150 may be either a membrane or desiccant type, such as the Cargocaire model "HC-150" manufactured by Munters, the specification of which is incorporated herein by reference. As used herein, the term "dehumidifier" refers to any device, component, system, etc., that receives a moisture carrying or a moisture laden gas, removes moisture from the gas, exhausts the removed moisture, and outputs a dry gas. The preferred dehumidifier 150 should be powerful enough to recirculate the workspace atmosphere between approximately two and four times per minute. However, the capacity of the dehumidifier 150 depends in part on the volume of the workspace 22 and the present invention is not limited or otherwise defined by the capacity of the dehumidifier 150.

There are two outputs from the dehumidifier 150: an exhaust port 156 and a dry air output port 154. The exhaust port 156 provides the path through which moisture enriched air or gases from the workspace 22 are channeled out of the humidity control system 10 and preferably out of the cryogenic cleaning system 100. The exhaust port 156 also serves as an exhaust line for any over-pressurization that exists within the cleaning chamber 20. A filter (not shown) may be provided at the exhaust port 156 and located within the cleaning chamber 20. Anywhere along this exhaust and vent route defined by the exhaust port 156, filters, scrubbers, or any other necessary environmental units can be installed.

Figure 2:
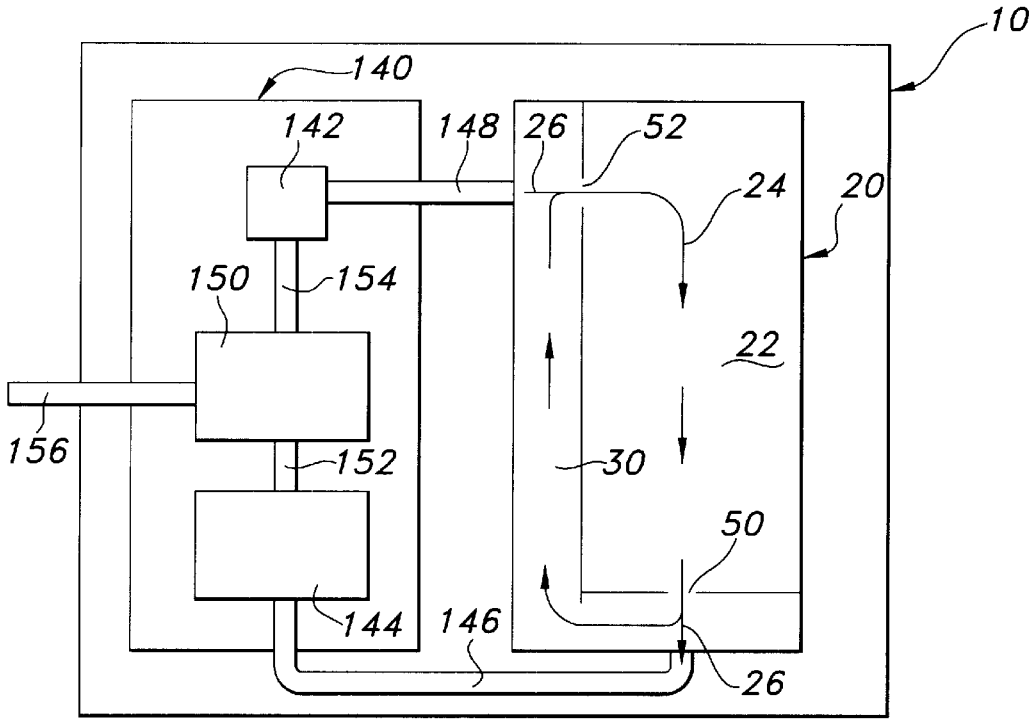
FIG. 2 is a schematic block diagram of a humidity control system having a dehumidifier connected in series with an secondary airflow path which runs parallel to a primary airflow path and constructed in accordance with the present invention.
Figure 4:
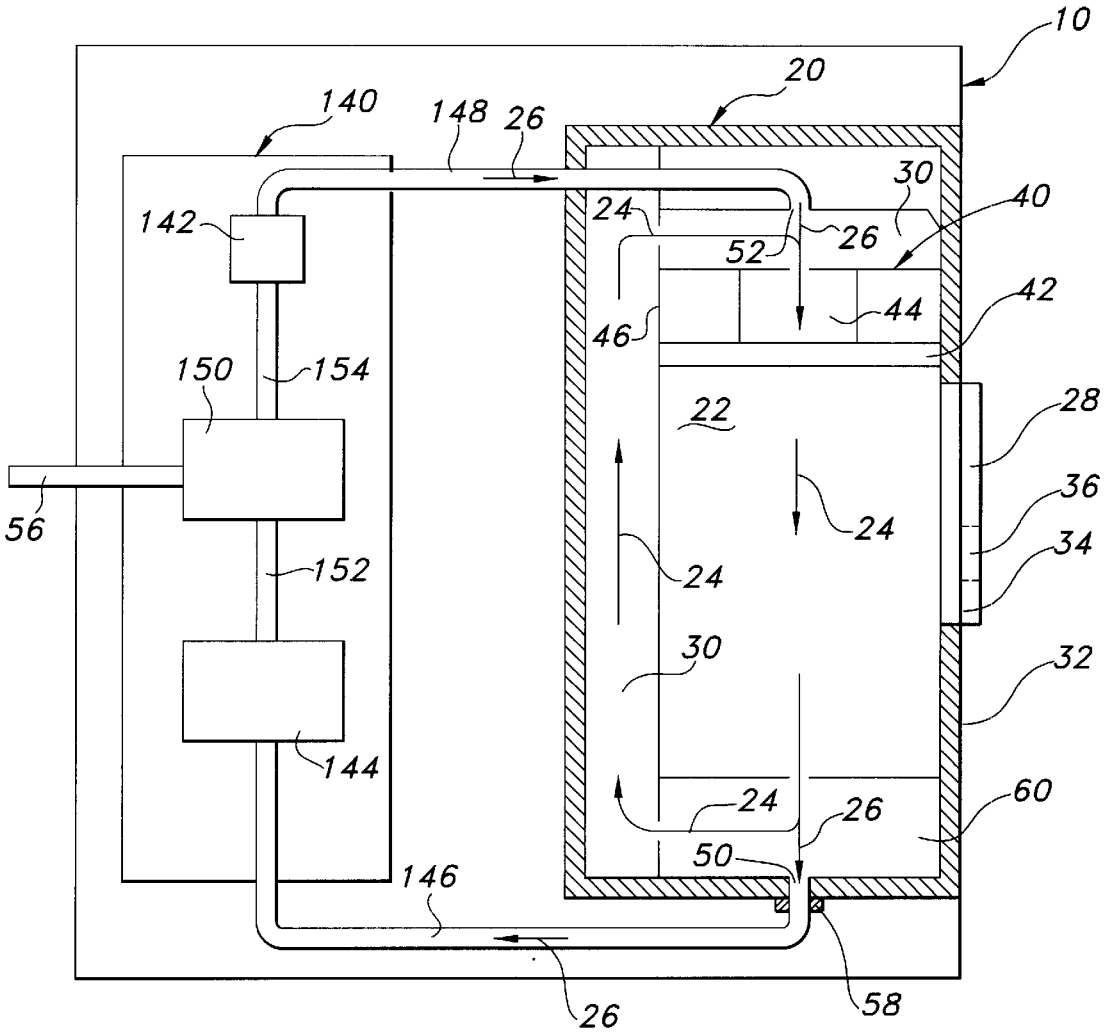
FIG. 4 is a detailed view of the humidity control system of FIG. 2.

In a second embodiment of the present invention shown in FIGS. 2 and 4, primary and secondary airflow paths 24, 26 are defined within the humidity control system 10. The primary airflow path 24 flows through the workspace 22 and also through a conduit or channel 30 defined adjacent thereto. Preferably, less than 100% of the workspace atmosphere (i.e., the volume of air in the workspace 22) flows through the conduit 30, with the remaining atmosphere flowing through the air handling system 140 over the secondary airflow path 26. Preferably, a minimum 10%, and more preferably 20%, of the volume of workspace atmosphere flows over the secondary airflow path 26, although this amount may vary. The blower 44 of the particulate filter assembly 40 primarily facilitates the movement of the workspace atmosphere over the primary airflow path 24, while the blower 144 of the air handling system 140 facilitates the movement of air over the secondary airflow path 26. Air exits the workspace 22 and enters an uptake region 60 defined therebelow. From the uptake region 60, the airflow through the cleaning chamber 20 is divided between the primary airflow path 24 and the secondary airflow path 26. The air flowing over the primary airflow path 24 flows through the conduit 30 and is drawn into the workspace 22 by the blower 44 of the filter assembly 40. The air flowing over the secondary airflow path 26 is drawn through the dehumidifier 150 (i.e., through the air handling system 140). Air Bowing over the secondary airflow path 26 re-enters the cleaning chamber 20 and the workspace 22 through the chamber input port 52 and is directed through the workspace 22 by the blower 44.

Figure 5:
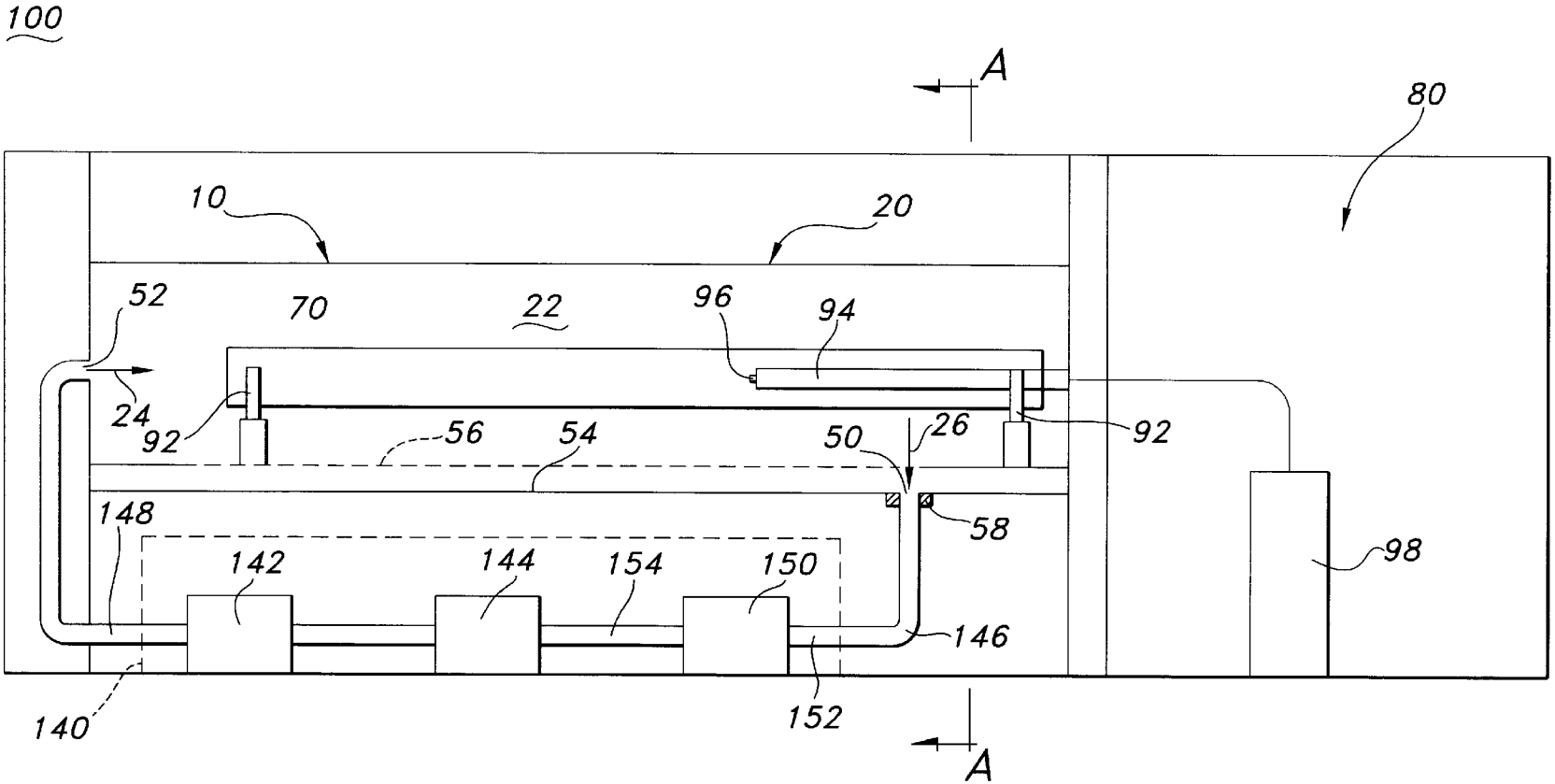
FIG. 5 is a front view of a preferred embodiment of a cryogenic aerosol spray cleaning system having an air handling system including a dehumidifier and constructed in accordance with the present invention.
Figure 6:
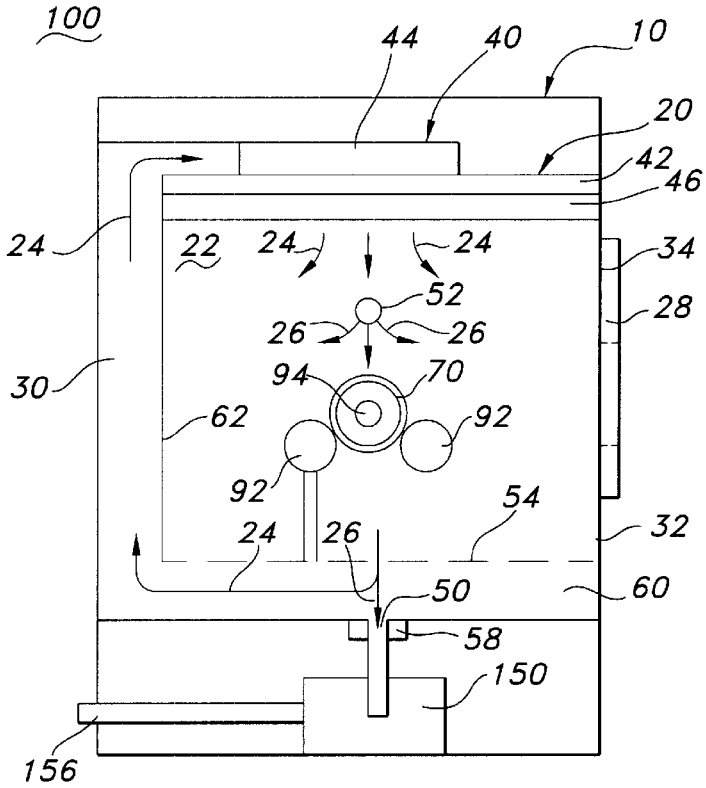
FIG. 6 is a side view taken along the ling A—A of FIG. 5.

Referring to FIGS. 5 and 6, there is shown a preferred embodiment of the invention. The cryogenic cleaning system 100 of this embodiment is constructed for automated cleaning and generally includes a controller section 80 and a cleaning section 90 comprising a humidity control system 10 including a cleaning chamber 20 and an air handling system 140. The controller section 80 houses the electrical, mechanical, and electro-mechanical components for the cryogenic cleaning system 100. In this embodiment, the controller 80 includes a plurality of cabinets which house control circuitry, robotics, cleaning medium sources and spray devices, etc.

The cleaning chamber 20 is generally a rectangular cube that is sized and shaped to accommodate large workpieces 70 such as, for example, long glass tubes. The cleaning chamber 20 may include components for automatic loading and unloading of the workpiece 70, components 92 for automatically moving the workpiece 70 within the workspace 22, components 94 for automatically cleaning the workpiece 70 using a cryogenic aerosol spray cleaning process including a spray nozzle connected to a cleaning media source 98 (e.g., carbon dioxide), and any other components necessary for performing any other functions or operations related to the cryogenic cleaning process.

At least one chamber output port 50 is provided in the chamber bottom 54 to permit the workspace atmosphere to pass out of the cleaning chamber 20 and through to the air handling system 140. The output port 50 may be equipped with a prefilter 58 to remove contaminants from the workspace atmosphere as it exits the cleaning chamber 20 and enters the air handling system input port 146. The moisture- and particle-laden air is drawn through the air handling system 140, at least in part, by the blower 144. The air enters the air handling system 140 through air handling system input port 146 and passes directly into the dehumidifier 150 via the dehumidifier input port 152.

There are two outputs from the dehumidifier 150: an exhaust port 156 and a dry air output port 154. The exhaust port 156 provides the path through which moisture enriched air or gases from the workspace 22 are channeled out of the humidity control system 10 and preferably out of the cryogenic cleaning system 100. The exhaust port 156 also serves as an exhaust line for any over-pressurization that exists within the cleaning chamber 20. A filter (not shown) may be provided at the exhaust port 156 and located within the cleaning chamber 20. Anywhere along this exhaust and vent route defined by the exhaust port 156, filters, scrubbers, or any other necessary environmental units can be installed.

Dry air exits the dehumidifier 150 via the dry air output port 154, and is drawn through the blower 144, and into the HEPA filter 142. Clean dry air is output from the air handling system 140 via the air handling system output port 148 and is returned to the cleaning chamber 20 via cleaning chamber input port 52 to provide a clean, dry workspace atmosphere. The blower 144 also boosts the velocity of the return airflow into the cleaning chamber 20. The blower 144 is preferably a high capacity air movement device designed to create a certain flow rate of clean dry air into the cleaning chamber 20. The HEPA filter 142 is optional, but recommended for most cleaning operations.

The bottom 54 of the cleaning chamber 20 may be perforated and configured to support the components 92 for automatically moving the workpiece 70. The cleaning chamber back wall 62 extends down to the bottom 54 of the cleaning chamber 20, as shown in FIG. 6. Located beneath the chamber bottom 54 is the uptake region 60 which is fluidly connected to the conduit 30 and which together define a portion of the primary airflow path 24. It can be seen in FIG. 6 that the conduit 30 is adjacent to and extends generally vertically behind the workspace 22. The workspace atmosphere is drawn through the conduit 30 and up behind the cleaning chamber 20 by the blower 44 of the filter assembly 40. This recirculated air passes through the HEPA filter 42, into the ductwork 46, and back into the workspace 22 where it blends with the clean dry air from the secondary airflow path 26.

A second airflow path 26 is provide in parallel with the primary airflow path 24. The air handling system 140 is provided in the second airflow path 26 and at least a portion of the workspace atmosphere is either continuously or intermittently directed along the second airflow path 26. In this way, moisture and particulate matter are removed from the workspace atmosphere.

Another feature of the humidity control system 10 of this embodiment is the door 28. Since the embodiment shown in FIGS. 5 and 6 is constructed for automated cryogenic cleaning of a large, long workpiece 70, the door 28 must permit for the entry and exit of such a large workpiece 70. As such, there are rails (not shown along which the door 28 may be guided generally in an up and down direction. The rails are designed such that when the door reaches a closing height, it is automatically forced toward the cleaning chamber front surface 32, and sealed thereto by the gasket 34. The large size of the door 28 prevents the formation of an airtight seal between the door 28 and front surface 32 of the cleaning chamber 20. However, this will not affect the performance or operation of the humidity control system 10 of the present invention because the dehumidifier 150 will remove any moisture entering the cleaning chamber 20 through the door 28.

In operation, the humidity control system 10 of the present invention circulates the entire workspace atmosphere between two and four times per minute. This may be continuous or intermittent, as a matter of design choice. For continuous circulation, the workspace atmosphere is quickly dehumidified when a new workpiece is placed in the cleaning chamber 20 for cleaning. In situations where the cleaning chamber 20 is not sealed against an outside environment, the humidity control system 10 of the present invention removes any moisture in the workspace atmosphere introduced from the outside environment.

Figure 7:
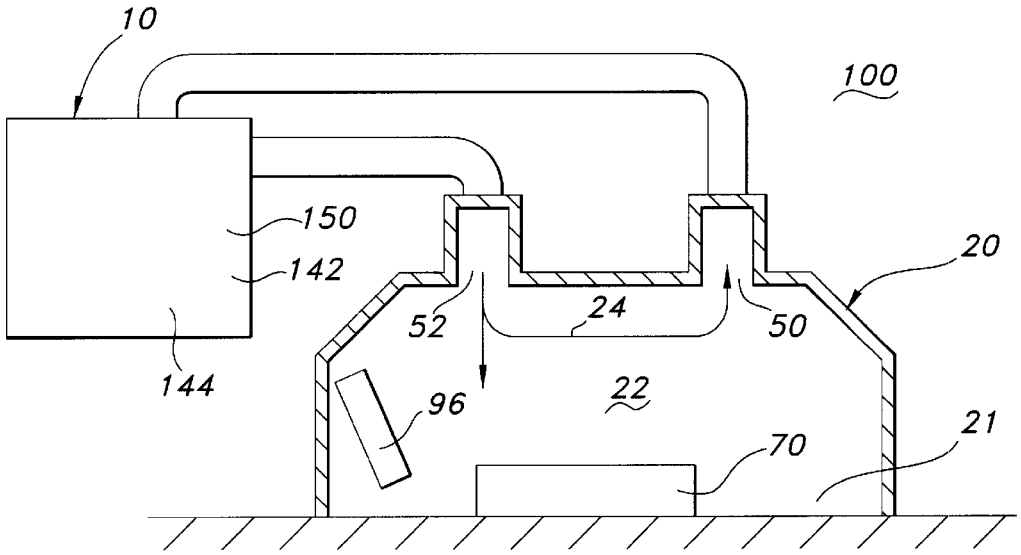
FIG. 7 is a side view of a hand-held cryogenic cleaning system having a humidity control system constructed in accordance with the present invention.

The present invention may also be applied to portable cryogenic cleaning systems, such as depicted in FIG. 7, where a hand-held cleaning chamber 20 connects to a humidity control system 10 for controlling the moisture content in the atmosphere within the workspace 22. One side of the cleaning chamber 20 is substantially open and may be placed over a workpiece 70. Cryogenic cleaning of the workpiece 70 is effected using a spray cleaning nozzle 96 connected to a cleaning media source 98 (not shown in this figure). The humidity control system 10 draws the workspace atmosphere out of the workspace 22 through a chamber output port 50. The humidity control system 10 includes a dehumidifier 150 through which the workspace atmosphere flows and which removes moisture from the workspace atmosphere. A HEPA filter 142 may be included in the humidity control system 10 for removing particulate matter from the workspace atmosphere. A blower 144 is provided in the humidity control system 10 to drawn the moisture- and particle-laden workspace atmosphere out of the cleaning chamber through output port 50. The blower 144 also directs clean, dry air back into the workspace through chamber input port 52.

While the various cleaning chamber 20 embodiments shown in the figures and discussed herein were either generally rectangular cubes, enclosed on all sides, or generally rectangular cubes having an open side, it will be obvious to persons skilled in the art that these are not limitations of the present invention but rather, merely illustrative examples of preferred embodiments of the present invention. The humidity control system 10 of the present invention is not restricted to such cleaning chamber 20 geometries. Therefore, cleaning chambers 20 having various other geometries and having openings, doors, loadlocks, etc., are also contemplated by the present invention.

The present invention provides a humidity control system 10 for cryogenic aerosol spray cleaning systems that continuously or intermittently circulates the workspace atmosphere through a dehumidifier, and then through an optional HEPA filter, to provide the clean and dry environment necessary for precision cleaning, in general, and specifically for cryogenic cleaning. Purging with dry gases or inert gases is no longer necessary. Load locks located at the ingress and egress locations of the cleaning chamber are also eliminated by the present invention. Furthermore, long dry out times for cryogenic cleaning chambers are no longer necessary with the humidity control system 10 of the present invention. The advantage of a dehumidifier also allows for simpler chamber design in that critical drying out of the cleaning chamber is not necessary—the dehumidifier performs the function of drying the chamber quickly. The actual drying out time is determined by the chamber volume, the extent on which the chamber is sealed, and the flow rates of the dehumidifier.

Having thus described the invention in rather fall detail, it will be recognized that such detail need not be strictly adhered to but that various changes and modifications may suggest themselves to one skilled in the art, all falling within the scope of the invention, as defined by the subjoined claims.

What is claimed is:

1. A humidity control system for a cleaning chamber of a cryogenic cleaning system, the cleaning chamber having a workspace defined therein within which a workpiece may be removably placed for cleaning during a cryogenic cleaning cycle, the workspace having a partly gaseous atmosphere therein and the cleaning system having an airflow path defined therethrough, the cryogenic cleaning system further including a spray nozzle located within the cleaning chamber and connected to a cleaning media source for producing a stream of solid or liquid crygenic spray entrained by a gas phase for cryogenically cleaning the workpiece during a cleaning cycle, said humidity control system comprising a dehumidifier of an air handling system located in the airflow path and through which the workspace atmosphere is circulated for removing moisture from the gaseous part of the workspace atmosphere and to reduce the humidity in the workspace without having to purge the cleaning chamber prior to initiation of a cleaning cycle.

2. A humidity control system as recited by claim 1, wherein the workspace atmosphere is continuously circulated through said dehumidifier.

3. A humidity control system as recited by claim 1, wherein the workspace atmosphere is intermittently circulated through said dehumidifier.

4. A humidity control system as recited by claim 1, wherein approximately 100% of the workspace atmosphere is circulated through said dehumidifier.

5. A humidity control system as recited by claim 1, wherein less than approximately 100% of the workspace atmosphere is circulated through said dehumidifier.

6. A humidifier control system as recited by claim 1, wherein the cleaning media is carbon dioxide, argon, nitrogen, neon, or mixtures thereof and wherein the crygenic cleaning comprises snow cleaning.

7. A humidity control system as recited by claim 1, wherein said air handling further comprises a particulate filter connected in series with said dehumidifier and for removing particulate matter from the workspace atmosphere.

8. A humidity control system as recited by claim 1, wherein the cleaning chamber is substantially enclosed on all sides.

9. A humidity control system as recited by claim 8, wherein the cleaning chamber includes an opening through which the workpiece may be moved into and out of the workspace.

10. A humidity control system as recived by claim 1, wherein the cleaning chamber is partially enclosed.

* * * * *